US008678712B2

(12) United States Patent
Marshall

(10) Patent No.: US 8,678,712 B2
(45) Date of Patent: Mar. 25, 2014

(54) SYSTEM FOR FORMING A MOVABLE SLAB FOUNDATION

(75) Inventor: Frederick S. Marshall, Arlington, TX (US)

(73) Assignee: Frederick S. Marshall, Dallas, TX (US)

( * ) Notice: Subject to any disclaimer, the term of this patent is extended or adjusted under 35 U.S.C. 154(b) by 378 days.

(21) Appl. No.: 12/875,622

(22) Filed: Sep. 3, 2010

(65) Prior Publication Data

US 2011/0056150 A1 Mar. 10, 2011

Related U.S. Application Data

(60) Provisional application No. 61/239,823, filed on Sep. 4, 2009.

(51) Int. Cl.
*E02D 5/00* (2006.01)

(52) U.S. Cl.
USPC ..... 405/229; 405/232; 52/632

(58) Field of Classification Search
USPC ..... 405/229, 232, 235, 256, 244, 251, 239, 405/252, 230; 52/632, 126.5, 126.1, 169.9, 52/169.13, 297
See application file for complete search history.

(56) References Cited

U.S. PATENT DOCUMENTS

| | | | | |
|---|---|---|---|---|
| 2,720,017 | A * | 10/1955 | Youtz | 52/745.13 |
| 4,017,115 | A * | 4/1977 | Holt et al. | 294/89 |
| 4,925,345 | A * | 5/1990 | McCown et al. | 405/232 |
| 4,997,314 | A * | 3/1991 | Hartman | 405/236 |
| 5,131,790 | A | 7/1992 | Simpson | |
| 5,228,807 | A | 7/1993 | Willcox, Jr. | |
| 5,259,702 | A | 11/1993 | Simpson | |
| 5,531,479 | A * | 7/1996 | Bauer | 280/806 |
| 5,713,701 | A | 2/1998 | Marshall | |
| 6,390,734 | B1 | 5/2002 | Marshall | |
| 6,503,024 | B2 * | 1/2003 | Rupiper | 405/230 |
| 6,551,030 | B1 * | 4/2003 | Curry | 405/251 |
| 6,634,830 | B1 | 10/2003 | Marshall | |
| 6,923,599 | B2 | 8/2005 | Kelso | |
| 7,967,531 | B2 * | 6/2011 | Collina et al. | 405/230 |
| 8,171,678 | B2 * | 5/2012 | Stanford et al. | 52/125.5 |
| 2007/0028557 | A1 * | 2/2007 | Kelly et al. | 52/741.15 |
| 2008/0175673 | A1 * | 7/2008 | Roberts et al. | 405/230 |
| 2009/0211178 | A1 | 8/2009 | Marshall et al. | |
| 2011/0023384 | A1 * | 2/2011 | Marshall | 52/125.1 |

OTHER PUBLICATIONS

U.S. Appl. No. 12/834,585, filed Jul. 12, 2010.
U.S. Appl. No. 12/395,033, filed Feb. 27, 2009.
U.S. Appl. No. 12/844,285, filed Jul. 27, 2010.
U.S. Appl. No. 12/571,067, filed Sep. 30, 2009.
U.S. Appl. No. 12/872,120, filed Aug. 31, 2010.

* cited by examiner

*Primary Examiner* — Thomas B Will
*Assistant Examiner* — Jessica H Lutz
(74) *Attorney, Agent, or Firm* — Bracewell & Giuliani LLP

(57) ABSTRACT

A system for forming a movable slab foundation has a slab foundation, at least one support surface, at least one lifting member, at least one support sleeve, and an engagement device carried by the at least one support sleeve. The at least one support sleeve is encased within the slab foundation and its lower end is positioned in abutting contact with the at least one support surface. The at least one lifting member is inserted through the at least one support sleeve. The at least one support sleeve and the slab foundation are moved upward axially along the length of the at least one lifting member. The engagement device is engaged with the at least one lifting member, thereby securing the slab foundation and the at least one support sleeve at a desired height.

11 Claims, 4 Drawing Sheets

SYSTEM FOR FORMING A MOVABLE SLAB FOUNDATION

CROSS REFERENCE TO RELATED APPLICATIONS

This application claims the benefit of and priority to U.S. Provisional Patent Application No. 61/239,823, filed on Sep. 4, 2009, herein incorporated by reference in its entirety.

FIELD OF THE INVENTION

This invention relates in general to forming an adjustable foundation, and in particular, to a concrete slab foundation capable of being raised above the ground.

BACKGROUND OF THE INVENTION

Many structures have been built on foundations or slabs made of concrete poured on top of soil. Constant changes in the weather and moisture levels in the soil frequently cause damage to such a foundation. In many instances, the foundation may buckle or even crack. This phenomenon occurs for a variety of reasons, including uneven changes in the water content of supporting soils, uneven compacting of soils, and uneven loads being placed on soils. Over time, uneven movement in the soils under a foundation can cause a foundation to bend or crack.

Therefore, it would be desirable to provide a method and apparatus that would allow a foundation to be poured on top of soil and subsequently raised to a desired height to eliminate potential problems caused by soil movement and/or problematic soils.

SUMMARY OF THE INVENTION

An embodiment of the system for forming a movable slab foundation as comprised by the present invention has a slab foundation and at least one support surface. At least one substantially vertical lifting member has first and second ends, the first end abuttingly contacts the at least one support surface. At least one support sleeve surrounds the at least one lifting member. The at least one support sleeve is encased within the slab foundation and is capable of movement axially along the length of the at least one lifting member. An engagement device is carried by the at least one support sleeve and is adapted to be engaged with the at least one lifting member when the slab is raised to a desired height, thereby preventing the at least one support sleeve from moving axially downward along the length of the at least one lifting member.

An embodiment of the system for forming a movable slab foundation as comprised by the present invention has a slab foundation and at least one support surface. At least one substantially vertical lifting member has a substantially cylindrical body with first and second ends, the first end abuttingly contacts the at least one support surface. At least one support sleeve surrounds the at least one support member. The at least one support sleeve has a hollow body with inner and outer surfaces. The inner surface of the body has a plurality of apertures located in and extending therethrough. The outer surface of the body has at least one reinforcing bar connected to and extending outwardly therefrom. The outer surface of the body and the at least one reinforcing bar are encased within the slab foundation. The at least one support sleeve and the slab foundation are capable of movement axially along the length of the at least one lifting member. A chuck body surrounds the at least one lifting member and is connected to the at least one support sleeve. The chuck body has a tapered inner surface that extends downwardly and outwardly from the at least one lifting member. The lower end of the tapered inner surface extends inward thereby forming a substantially upward facing shoulder. A shim surrounds the at least one lifting member. The shim is surrounded by the chuck body and has a tapered outer surface that is substantially geometrically complimentary to the inner surface of the chuck body. The tapered outer surface extends downwardly and outwardly from the at least one lifting member. The lower end of the tapered outer surface extends inward thereby forming a substantially downward facing shoulder. The shim has an inner surface that is substantially parallel to the at least one lifting member. The upward facing shoulder of the chuck body initially engages the downward facing shoulder of the shim such that the chuck body and the shim travel upward simultaneously. The chuck body is capable of limited downward movement independent of the shim. The limited downward movement of the chuck body causes the shim to engage the at least one lifting member, thereby restricting the movement of the chuck body downward relative to the lifting member and securing the sleeve and slab foundation at the desired height.

An embodiment of the present invention is directed to a method for forming a movable slab foundation. The method comprises placing a plurality of support surfaces below an intended slab foundation area. A plurality of support sleeves are placed in abutting contact with the plurality of support surfaces. A plurality of lifting members are placed within the plurality of support sleeves and moved downward within the plurality of support sleeves and into abutting contact with the plurality of support surfaces. A slab foundation is formed such that it encases the plurality of support sleeves. The plurality of support sleeves are simultaneously lifted to move the slab foundation along the length of the plurality of support members to a desired height. An engagement device carried by each of the plurality of support sleeves is engaged with each of the plurality of lifting members, thereby restricting the movement of the plurality of support sleeves downward relative to the plurality of lifting members and maintaining the desired height of the slab foundation.

BRIEF DESCRIPTION OF THE DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION OF THE INVENTION

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
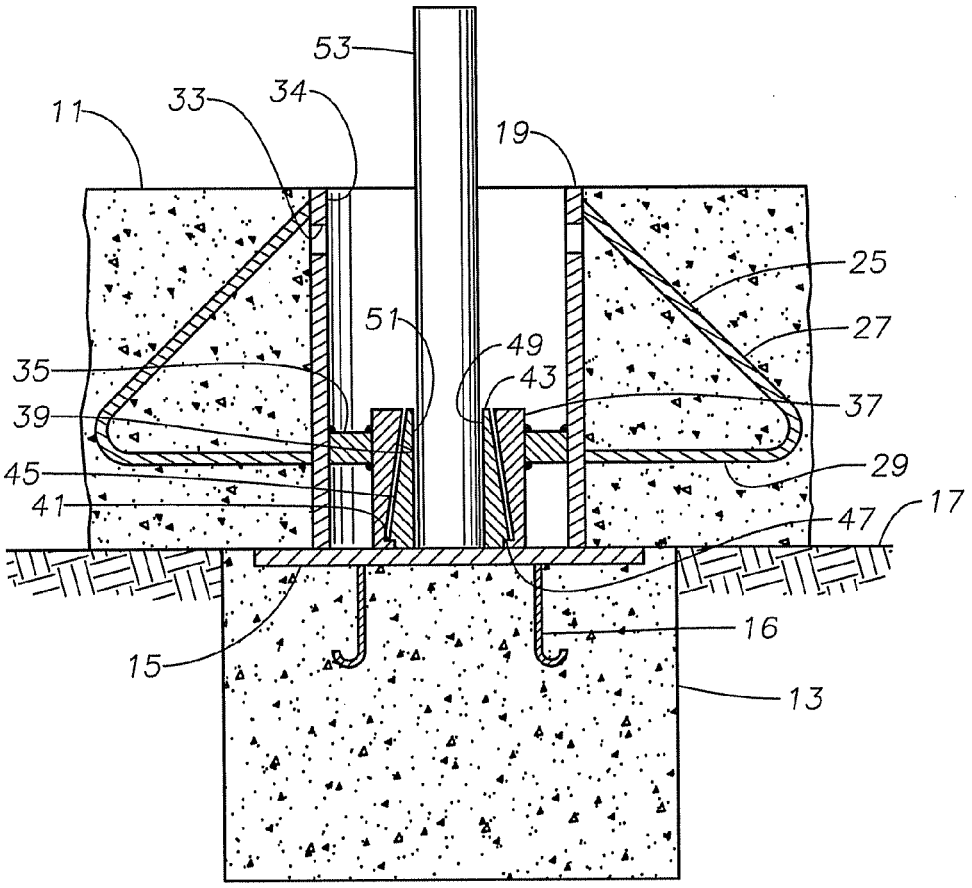
FIG. 1 is a sectional view of a single slab support illustrating a concrete pier, a support sleeve, and a lifting rod.

Referring to FIG. 1, a foundation slab 11 may be used to support a house or other building or structure. In this embodiment, the slab 11 is of concrete and initially rests on a ground surface 17 and a support surface or pier 13. The foundation or slab 11 is typically supported by a plurality of support surfaces or piers 13, but for simplification purposes, the single pier 13 will be discussed. In this embodiment, the pier 13 is of concrete and has a base plate 15 embedded therein, such that at least the top or upper surface of the base plate 15 is exposed. In this embodiment, the base plate 15 is circular in shape, but in alternate embodiments may comprise different shapes, for example, a rectangle. In this embodiment, the base plate 15 has anchor bolts 16 connected to it that extend a select distance into the concrete of the pier 13. In alternate embodiments, other support members may be connected to the base plate 15.

In this embodiment, the hole for the pier 13 is dug with a diameter such that the base plate 15 is fully encased within the concrete. Once the hole is dug, the pier 13 is formed by pouring concrete into the hole. The base plate 15 is then embedded in the concrete of the pier 13 such that the top or upper surface of the base plate 15 is substantially parallel with the ground surface 17. As previously discussed, in this embodiment, the anchor bolts 16 are connected to the base plate 15 and extend into the concrete of the pier 13 a distance below the base plate 15.

In this embodiment, a cylindrical exterior pipe or support sleeve 19 has an outer diameter that is less than the diameter of the base plate 15. The support sleeve 19 and the base plate 15 are sized such that the bottom surface of the support sleeve 19 is in supporting contact with the base plate 15. The length of support sleeve 19 is less than or equal to the desired thickness of the concrete slab 11. Reinforcing bars (rebar) 25 are connected to the outer surface of the sleeve 19. In this embodiment, a first leg 27 of the rebar 25 is connected to and extends outwardly and downwardly at an angle from the sleeve 19. A second leg 29 of the rebar 25 is substantially perpendicular to the support sleeve 19 and extends between the first leg 27 and the sleeve 19. The rebar 25 may be welded around the outer peripheries of the sleeve 19 at desired intervals. In an alternate embodiment, various reinforcing members may be connected to and extend outwardly from the outer peripheries of the sleeve 19 in various shapes and configurations.

A plurality of lift holes or apertures 33 are located in and extend radially outward through the inner surface 34 of the support sleeve 19. In this particular embodiment, two lift holes 33 are positioned opposite from one another. The lift holes 33 are designed to accept a lifting device or a lifting link.

A plate 35 is connected to the inner surface 34 of the sleeve 19. The plate 35 extends radially inward from the inner surface of the sleeve 19 before connecting to a chuck body 37. The chuck body 37 has a generally wedge-shaped cross section with a tapered inner surface 39. A small flange extends radially inward from the bottom of the tapered surface 39, thereby forming an upward facing shoulder 41. A shim 43 has a generally wedge-shaped cross section with a tapered outer surface 45 that is geometrically complimentary to the tapered inner surface 39 of the chuck body 37. The shim 43 rides within the chuck body 37. A small recess is located in and extends radially inward from the bottom of the tapered surface 45, thereby forming a downward facing shoulder 47. The inner surface 49 of the shim 43 has a plurality of downward angled teeth (not shown) extending along its length. An aperture or passage 51 extends axially through the center of the shim 43. The downward facing shoulder 47 of the shim 43 initially abuts against the upward facing shoulder 41 of the chuck body 37.

The sleeve assembly 19 is positioned atop the base plate 15. In an alternate embodiment, the lower end of the support sleeve 19 may be lightly tack welded to the base plate 15. The concrete slab 11 is then poured, which embeds the rebar 25 and the sleeve 19 within the slab 11. The concrete may be kept from bonding to the concrete pier 13 and the base plate 15 by an optional bond breaker layer (not shown).

Referring to FIG. 1, after the cement slab 11 has hardened, a lifting member or solid lifting rod or column 53 with a smaller diameter than the passage 51 in the shim 43 is inserted into and through the passage 51 and lowered until it makes contact with the base plate 15. The lifting rod 53 is positioned such that the lower first end portion of the lifting rod 53 rests on the base plate 15. The lifting rod 53 extends upwardly a selected distance from the base plate 15. The length of the lifting rod 53 can be varied to accommodate various desired slab 11 heights.

Figure 2:
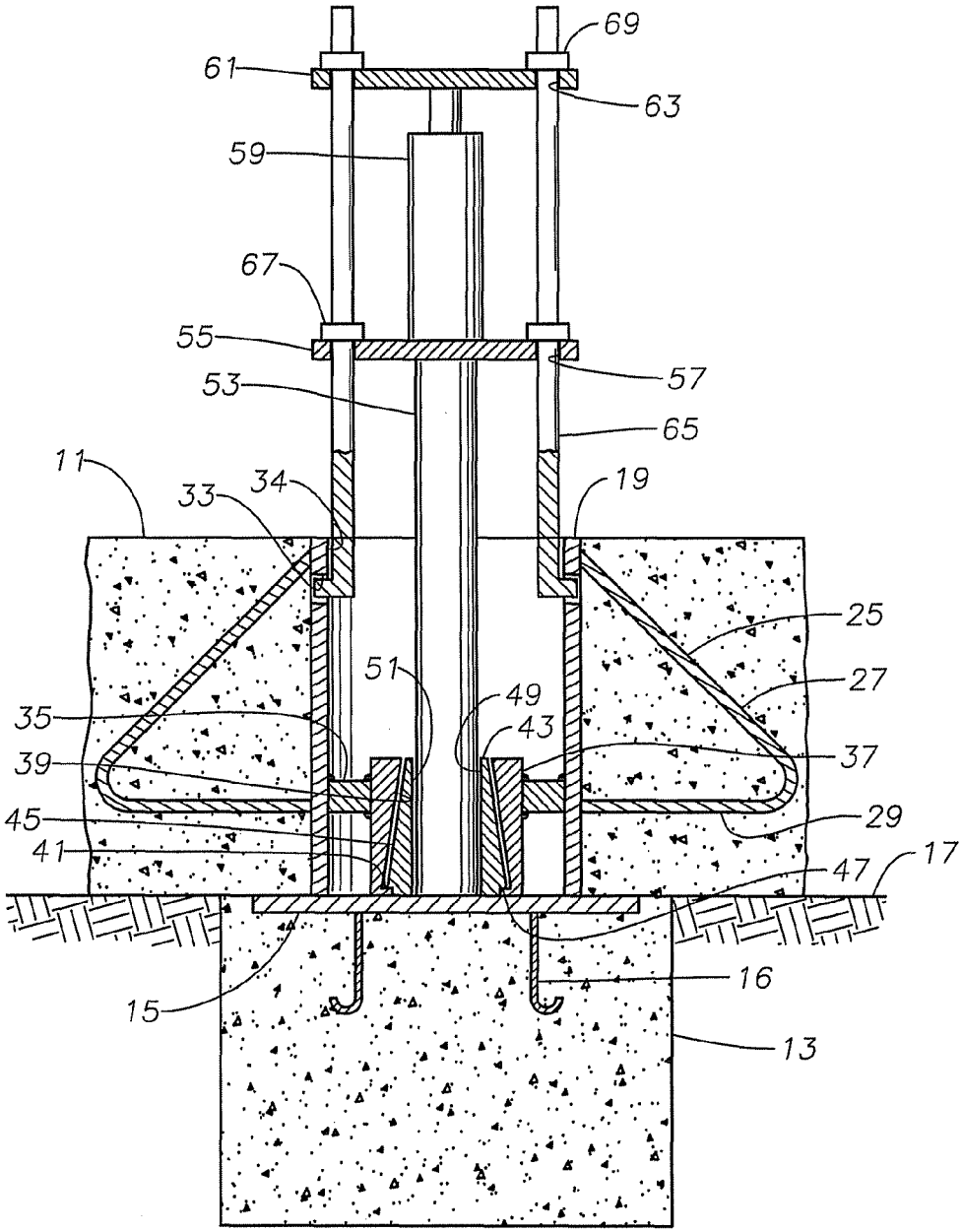
FIG. 2 is a sectional view of the single slab support with a lifting assembly connected

Referring to FIG. 2, after the lifting rod 53 is in place, a support plate 55 is positioned on the top of upper second end portion of the lifting rod 53. The support plate 55 has a plurality of apertures 57 located in and extending therethrough. A lifting device 59 is then mounted on the top of the support plate 55. In this embodiment, the lifting device 59 is a hydraulic jack mounted on the top of the support plate 55. A lift plate 61 is then positioned on the top of the hydraulic jack 59. The lift plate 61 has a plurality of apertures 63 located in and extending therethrough. The lift plate 61 is positioned such that the apertures 63 in the lift plate 61 are aligned with the apertures 57 in the support plate 55.

Attachment members or attachment rods 65 are connected to the lift holes 33 in the sleeve 19 in order to lift the slab 11 to its desired height. In this embodiment, the attachment rods 65 contain threads in at least an upper portion thereof. The attachment rods 65 pass through the apertures 57 in the support plate 55 and the apertures 63 in the lift plate 61. Nuts 67 are threaded onto upper portions of the attachment rods 65 located between the support plate 55 and the lift plate 61. The nuts 67 may be adjusted once the slab 11 has been lifted to permit removal of the hydraulic jack 59. The nuts 69 are threaded onto upper portions of the attachment rods 65, above the lift plate 61. The nuts 69 prevent the lift plate 61 from moving upward independently from the attachment rods 65 when the hydraulic jack 59 is activated.

Hydraulic fluid pressure is then applied to the jack 59, causing the jack 59 to lift the lift plate 61 and the attachment rods 65 upwards. As the lift plate 61 and the attachment rods 65 move upwards, the slab 11 and the sleeve assembly 19 encased therein also moves upwards. As the sleeve assembly 19 moves upwards, the chuck body 37 simultaneously moves upwards relative to the base plate 15. The upward facing shoulder 41 of the chuck body 37 abuts against the downward facing shoulder 47 of the shim 43, ensuring that the shim 43 simultaneously moves upward with the chuck body 37. The jack 59 moves the lift plate 61 and the attachment rods 65 upwards until the foundation slab 11 has been lifted above the ground surface 17 to a height slightly above the desired height. In the event that the hydraulic jack 59 needs to be removed during the lifting process, the nuts 67 can be tightened against the support plate 61, allowing the lifting device 59 and the lift plate 61 to be removed if necessary.

Figure 3:
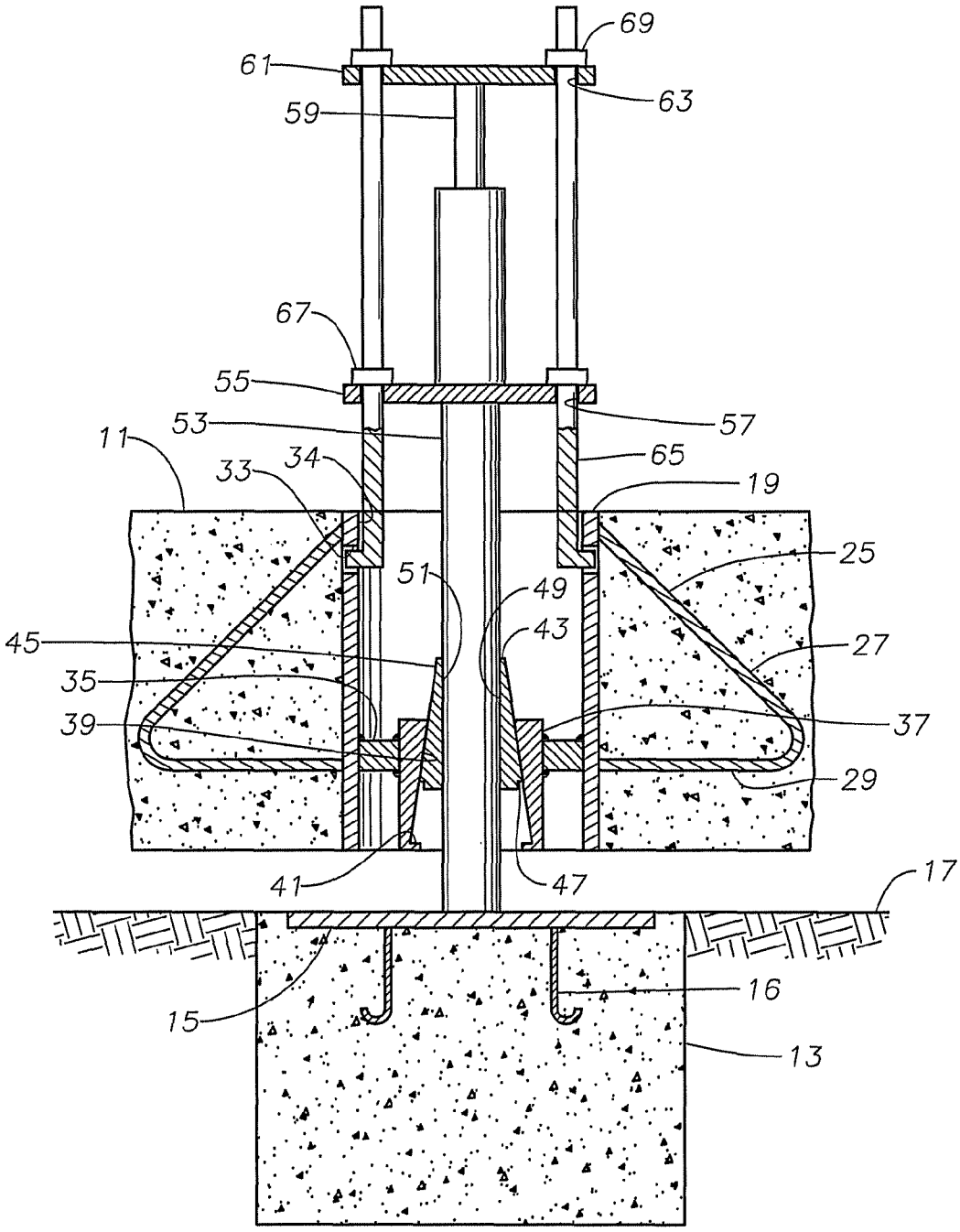
FIG. 3 is a sectional view of the single slab support with the lifting assembly connected and the slab raised a portion from a ground surface.

Referring to FIG. 3, once the slab 11 has reached a height slightly above its desired final height, the hydraulic jack 59 is lowered slightly, thereby transferring the weight of the slab 11 from the chuck body 37 to the shim 43. The tapered inner surface 39 of the chuck body 37 slidingly engages the tapered outer surface 45 of the shim 43, thereby applying an inward radial force to the shim 43. The shim 43 moves radially inward toward the lifting rod 53. The downward angled teeth (not shown) on the inner surface 49 of the shim 43 engage the lifting rod 53. As the slab 11, the sleeve 19, and the chuck body 43 move further downward relative to the shim 43, the inward radial force increases on the shim 43 and the downward angled teeth (not shown) on the inner surface 49 of the shim 43 further engage the lifting rod 53. As the downward angled teeth (not shown) of the shim 43 fully engage the lifting rod 53, the slab 11 is secured at its desired height.

Figure 4:
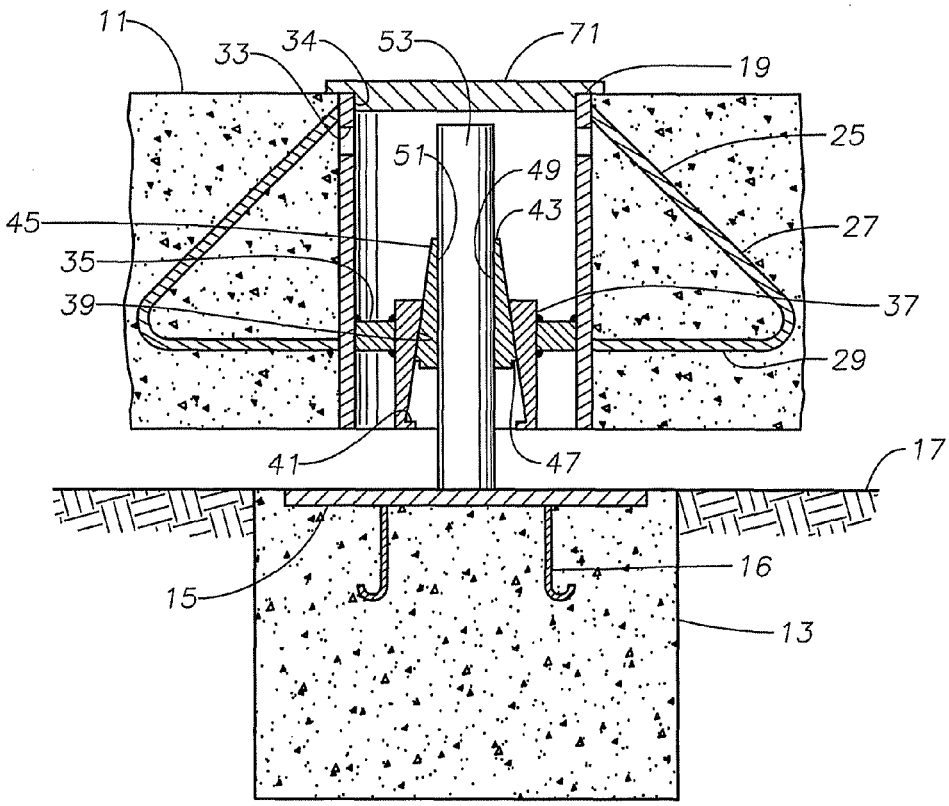
FIG. 4 is a sectional view of the single slab support with the slab raised to a final height and the lifting assembly disconnected.

Referring to FIG. 4, once the slab 11 is secured at its desired height, the attachment rods 65, the support plate 55, the hydraulic jack 59, and the lift plate 61 may be removed. If the lifting rod 53 extends above the slab 11, it may be cut to a height so that it does not extend above the slab 11. A cap 71 may be inserted into the sleeve 19. In the event that the height of the slab 11 needs to be adjusted, the cap 71 may be removed and the support plate 55, the hydraulic jack 59, the lift plate 61, and the attachment rods 65 may be reconnected. Once the slab 11 is lifted to a height such that the inward radial force from the chuck body 37 to the shim 43 ceases, the chuck body 37 and the shim 43 may then be moved upwards or downwards simultaneously relative to the base plate 15 to a new desired height. As previously discussed, when the slab 11 reaches a height slightly above its desired height, the chuck body 37 may then be permitted to move downward relative to the shim 43, thereby exerting a radial inward force on the shim 43 to engage the lift rod 53. Once the slab 11 is secured at its new height, the hydraulic jack 59, the support plate 55, the lift plate 61, and the attachment rods 65 may then be removed and the cap 71 may be reinstalled in the sleeve 19.

The invention has significant advantages. The invention provides a method and apparatus that allows a foundation to be poured on top of soil and subsequently raised to a desired height to eliminate potential problems caused by soil movement and/or problematic soils.

In the drawings and specification, there have been disclosed a typical preferred embodiment of the invention, and although specific teams are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as set forth in the following claims

The invention claimed is:

1. A method for forming a movable slab foundation, the method comprising:

(a) placing a plurality of support surfaces below an intended slab foundation area;

(b) placing a plurality of support sleeves in abutting contact with the plurality of support surfaces, each of the support sleeves having a side wall containing a plurality of lift holes therethrough;

(c) placing a column within each of the support sleeves into abutting contact with one of the support surfaces, each of the plurality of column members surrounded by an engagement device comprising:

a chuck body rigidly connected to one of the support sleeves, the chuck body having a tapered inner surface that extends downwardly and outwardly away from the column, the lower end of the tapered inner surface extending inward and forming a substantially upward facing shoulder; and a shim in the chuck body and having a tapered outer surface substantially geometrically complimentary to the inner surface of the chuck body, the tapered outer surface extending downwardly and outwardly from the column, the lower end of the tapered outer surface having a downward facing surface, the shim having an inner surface adjacent to the column;

(d) forming a slab foundation such that it encases the support sleeves;

(e) providing a plurality of hydraulic jacks, each having a lift plate on an upper end and a plurality of attachments rods connected to and extending downward from the lift plate;

(f) mounting each of the hydraulic jacks to an upper portion of one of the columns and inserting lower portions of the attachment rods into the lifting holes of the support sleeves;

(g) actuating the hydraulic jacks to move the lift plates and attachment rods upward, thereby lifting the support sleeves so that the upward facing shoulders of the chuck bodies contact the downward facing surfaces of the shims and the engagement devices move upward relative to the support surfaces, and so that the slab foundation moves along lengths of the columns to a desired height; and (h) then, with the hydraulic jacks, lowering the support sleeves relative to the shims until the tapered inner surfaces of the chuck bodies engage the tapered outer surfaces of the shims, thereby applying an inward radial force to the shims that causes the inner surfaces of the shims to move radially inward and lock against the columns, transferring a weight of the slab foundation to the columns.

2. The method of claim 1, wherein each of engagement devices further comprises a plate secured between an outer portion of the chuck body and an inner surface of one of the support sleeves.

3. The method of claim 1, wherein step (f) comprises placing each of the hydraulic jacks on an upper end of each of the columns.

4. The method of claim 1, wherein step (f) further comprises:

engaging a plurality of downward angled teeth on the inner surfaces of each of the shims with each of the columns.

5. The method of claim 1, further comprising after step (h):

while continuing to support the weight of the slab foundation with the engagement devices, removing the hydraulic jacks, the lift plates, and the attachment rods.

6. The method according to claim 1, wherein connecting the chuck body to the supporting sleeve comprises welding the chuck body to the supporting sleeve.

7. A method for forming and lifting a slab foundation, comprising:

(a) providing a plurality of support sleeves, each having a longitudinal axis, a concentric cylindrical side wall containing a plurality of lift holes therethrough, a chuck body rigidly secured to an inner surface of the side wall, and a shim carried within the chuck body, the chuck body and the shim having mating tapered surfaces that cause an inner surface of the shim to move radially inward when the chuck body and the support sleeve move downward relative to the shim;

(b) positioning each of the support sleeves on a supporting surface;

(c) inserting a column into each of the support sleeves and the chuck body therein such that the column surrounded by the shim;

(d) forming a slab foundation such that it encases and bonds to the support sleeves;

(e) providing a plurality of hydraulic jacks, each having a lift plate on an upper end and a plurality of attachments rods connected to and extending downward from the lift plate, each of the attachment rods having an outward protruding lug at a lower end;

(f) placing the hydraulic jacks on upper ends of the columns and inserting the lugs of the attachment rods into the lifting holes of the support sleeves;

(g) actuating the hydraulic jacks to move the lift plates and the attachment rods upward relative to the columns, thereby lifting the support sleeves, the chuck bodies, and the shims to a desired height; then (h) with the hydraulic jacks, lowering the support sleeves and the chuck bodies relative to the shims, thereby applying an inward radial force to the shims that causes the inner surfaces of the shims to move radially inward and lock against the columns to transfer a weight of the slab foundation to the columns; and then (i) while the shims continue to transfer the weight of the slab foundation to the columns, removing the hydraulic jacks, the lift plates, and the attachment rods.

8. The method of claim 7, wherein each of the chuck bodies is rigidly secured to the inner surface of one of the support sleeves by a plate welded to the inner surface of the support sleeve.

9. The method of claim 7, wherein the inner surfaces of each of the shims have downward angled teeth that grip each of the columns.

10. The method of claim 7, further comprising:

providing the tapered surface of each of the chuck bodies with an upward facing and inward protruding shoulder at a lower end of the tapered surface; and step (g) comprises engaging a lower end portion of each of the shims with one of the shoulders to prevent downward movement of the shims relative to the chuck bodies while the hydraulic jacks are lifting the supporting sleeves.

11. A method for forming and lifting a slab foundation, comprising:

(a) providing a plurality of support sleeves, each having a longitudinal axis, a concentric cylindrical side wall containing a plurality of lift holes therethrough;

(b) welding a chuck body to an inner surface of the side wall of each of the support sleeves, and a placing a shim within the chuck body, the chuck body and the shim having mating tapered surfaces that cause an inner surface of the shim to move radially inward when the chuck body and the support sleeve move downward relative to the shim, the chuck body having an upward facing shoulder that engages a downward facing surface of the shim to limit downward movement of the shim relative to the chuck body;

(c) positioning each of the support sleeves on a supporting surface;

(d) inserting a column into each of the support sleeves such that the column is resting on the supporting surface and surrounded by the shim;

(e) forming a slab foundation such that it encases and bonds to the support sleeves;

(f) providing a plurality of hydraulic jacks, each having a lift plate on an upper end and a plurality of attachments rods connected to and extending downward from the lift plate, each of the attachment rods having an outward protruding lug at a lower end;

(g) placing the hydraulic jacks on upper ends of the columns and inserting the lugs of the attachment rods into the lifting holes of the support sleeves;

(h) actuating the hydraulic jacks to move the lift plates and the attachment rods upward, thereby lifting the support sleeves, the chuck bodies, and the shims to a desired height; then (i) with the hydraulic jacks, lowering the support sleeves and the chuck bodies relative to the shims, thereby applying an inward radial force to the shims that causes the inner surfaces of the shims to move radially inward and lock against the columns, transferring a weight of the slab foundation to the columns; and then (j) while the shims continue to transfer the weight of the slab foundation to the columns, removing the hydraulic jacks, the lift plates, and the attachment rods.

* * * * *